US008011812B2

(12) United States Patent
Schnitzer

(10) Patent No.: US 8,011,812 B2
(45) Date of Patent: Sep. 6, 2011

(54) ILLUMINATING TOWER

(75) Inventor: Martin Schnitzer, San Francisco, CA (US)

(73) Assignee: Bay Area Sports Organizing Committee, Palo Alto, CA (US)

( * ) Notice: Subject to any disclaimer, the term of this patent is extended or adjusted under 35 U.S.C. 154(b) by 225 days.

(21) Appl. No.: 12/485,870

(22) Filed: Jun. 16, 2009

(65) Prior Publication Data

US 2010/0315822 A1 Dec. 16, 2010

(51) Int. Cl.
*F21V 33/00* (2006.01)

(52) U.S. Cl. ..... 362/326; 362/433; 362/311.13; 362/311.01; 362/806; 362/35

(58) Field of Classification Search ..... 362/396, 362/326, 433, 311.01, 311.13, 312, 382, 362/408, 806, 35
See application file for complete search history.

(56) References Cited

U.S. PATENT DOCUMENTS

| | | | |
|---|---|---|---|
| D85,069 | S | 9/1931 | Webster, Jr. |
| D145,583 | S | 9/1946 | Lolli |
| D165,226 | S | 11/1951 | Gray et al. |
| D205,858 | S | 9/1966 | Klausen |
| D302,048 | S | 7/1989 | Dolfi |
| D443,716 | S | 6/2001 | Vong et al. |
| D536,478 | S | 2/2007 | McMinn |
| D591,895 | S | 5/2009 | Sabernig |
| D593,705 | S | 6/2009 | Bilotti |
| D604,451 | S | 11/2009 | Smith |
| D604,452 | S | 11/2009 | Smith |

*Primary Examiner* — Laura Tso
(74) *Attorney, Agent, or Firm* — Nixon Peabody LLP

(57) ABSTRACT

A tower includes a base configured to sit upon a surface. A light source is coupled to the base and is positioned a first horizontal distance from a center of the base. The light source is configured to produce light therefrom when energized. The tower includes a cylindrical outer body that is coupled to and positioned a second distance from the center of the base, wherein the second distance is greater than the first distance. The outer body is oriented to extend vertically from the surface and is configured to allow light from the light source to pass therethrough. A plurality of leaves are coupled to an outer surface of the outer body and are configured to hang therefrom. The leaves are configured to freely move with respect to the outer body when air flow is applied thereto, wherein light from the light source is viewable through the outer body when the leaves move.

18 Claims, 4 Drawing Sheets

ILLUMINATING TOWER

TECHNICAL FIELD

The present disclosure relates generally to an illuminating tower.

BACKGROUND

Competitive games, such as the Olympic Games, have commonly employed a tower which is ignited by a torch which is carried among persons prior to the opening ceremony. In particular, the World Olympic Games has typically used a gas powered tower or cauldron which produces a flame once ignited. Although such towers are grand in design and symbolism, such devices are costly and require natural resources to continually maintain the flame for a set duration.

What is needed is an inexpensive and eco-friendly tower which emits light and simulates a traditional tower or cauldron.

OVERVIEW

In an aspect, a tower comprises a base configured to sit upon a surface. A light source is coupled to the base and is positioned a first horizontal distance from a center of the base. The light source is configured to produce light therefrom when energized. The tower includes a cylindrical outer body that is coupled to and positioned a second distance from the center of the base, wherein the second distance is greater than the first distance. The outer body is oriented to extend vertically from the surface and is configured to allow light from the light source to pass therethrough. A plurality of leaves are coupled to an outer surface of the outer body and are configured to hang therefrom. The leaves are configured to freely move with respect to the outer body when air flow is applied thereto, wherein light from the light source is viewable through the outer body when the leaves move.

In an aspect, a tower comprises a base configured to sit upon a surface. A center shaft is coupled to the base and is oriented to extend vertically with respect to the surface. A plurality of individually spaced ribs are coupled to the base, wherein each rib has an interior surface and an outer surface. Each rib is configured to extend upward in a helical configuration with respect to the center shaft to form an outer surface of the tower. The lower includes a plurality of leaves coupled to the outer surface of one or more of the plurality of ribs and a light source coupled to the base and located proximal to the interior surface of the ribs, wherein light produced by the light source passes at least through one spaced gap between adjacent ribs.

In one or more aspects above, one or more leaves are spaced apart to allow light from the light source to pass therebetween. The tower preferably includes a shaft is coupled to the base and oriented to extend vertically with respect to the surface. The outer body of the tower further comprises a plurality of individually spaced ribs, wherein each rib is configured to extend upward in a helical configuration with respect to a center. The light source further comprises a light emitting diode (LED). In an embodiment, the light source is configured to be selectively moveable via a motor. In an embodiment, the leaves are made of at least partially transparent material. Preferably each leaf includes an aperture therethrough to couple each leaf, wherein each leaf is coupled to the outer body via the aperture. The tower further comprises a plurality of protrusions extending from the outer surface of the ribs, wherein the protrusions pass through corresponding apertures in the leaves to hang the leaves from the protrusions. In an embodiment, the outer body of the tower has a top and a bottom, the top having a first diameter and the bottom having a second diameter, wherein the outer body has a middle portion between the top and the bottom wherein the middle portion has a diameter smaller than the first and second diameters.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Example embodiments are described herein in the context of an illuminating tower. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used throughout the drawings and the following description to refer to the same or like items. It is understood that the phrase "an embodiment" encompasses more than one embodiment and is thus not limited to only one embodiment.

Figure 1:
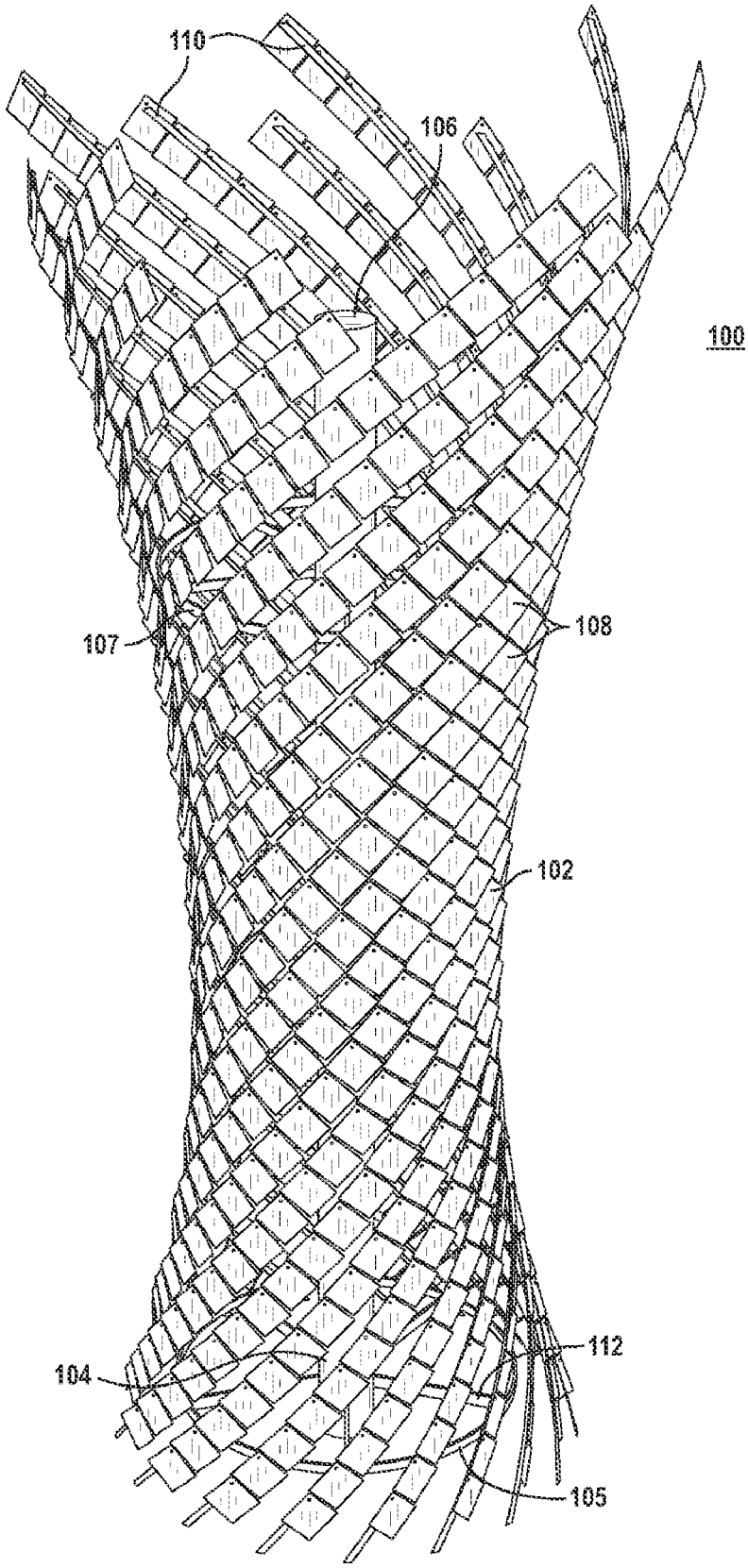
FIG. 1 illustrates a perspective view of the tower in accordance with an embodiment.

FIG. 1 illustrates a perspective view of the illuminating tower in accordance with an embodiment. In particular, as shown in FIG. 1, the tower 100 includes an outer body 102 and an interior support structure 104. The interior support structure 104 includes a center shaft 106 having a top surface and a bottom surface in which the bottom surface sits in contact with a ground surface such that the shaft 106 preferably extends vertically with respect to the ground. The support structure 104 preferably includes a bottom support ring 105 and a top support ring 107. The support rings 105, 107 are preferably coupled to the center shaft 106 via radially extending rods 112. The support rings 105, 107 are preferably circular although they may be any other desired shape. It should be noted that although two support rings 105, 107 are shown in the figure, any number of support rings are contemplated.

Figure 2:
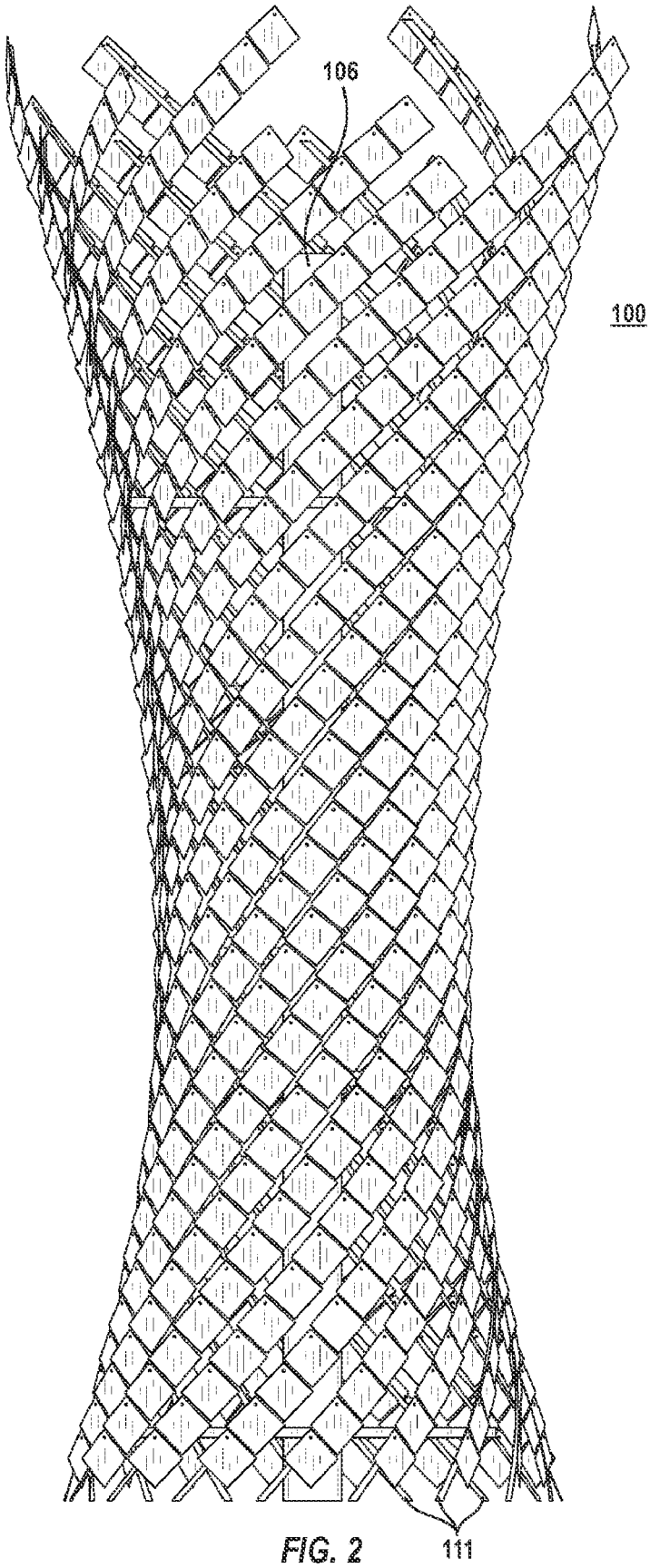
FIG. 2 illustrates a side view of tower in accordance with an embodiment.

The outer body 102 is preferably comprised of a plurality of individual ribs 110 which are coupled to the support rings 105, 107. In particular, the ribs 110 are configured in a twisted or helical configuration with respect to the center shaft 106 to form the overall outer body 102, whereby the ribs 110 are maintained in the helical configuration by being mounted at predetermined points on the circular support structures. In addition, the helically configured ribs are preferably separated from neighboring ribs 110 by a set distance to allow light produced from the light source 118 to pass between the ribs 110. Each rib, as shown in FIGS. 1 and 2, has a top and a bottom surface in which the ribs are positioned such that each of the bottom surfaces 111 of the ribs 11*o* maintains contact with the ground surface to hold the tower erect with respect to the ground. In an embodiment, the top of the ribs 110 are at different heights with respect to the ground surface, although the ribs may alternatively be at the same height with one another.

Referring back to FIGS. 1 and 2, the outer body 102 is shown to have a circular cross section, in that the top of the outer body has a diameter and the bottom of the outer body has a diameter. In the embodiment shown in FIGS. 1 and 2, the diameter at the top of the outer body is larger than the diameter at the bottom of the outer body. It should be noted that the diameter at the top may be smaller or equal to the diameter of the bottom of the outer body in one or more embodiment. In the embodiment shown in the Figures, the body 102 has a configuration in which the cross-sectional diameter of the body 102 gradually decreases to minimum diameter area proximate to area 109 from the bottom and then gradually increases from the area 109 to diameter at the top. Thus, the body 102 preferably has a varying cross-sectional diameter that forms a slight hourglass or hyperbolic shape, although it is not necessary that the body 102 have such a shaped configuration. It should also be noted that the body 102 may have any other cross sectional design (e.g. hexagonal, octagonal, square, and the like). It is preferred that the body 102 is made of steel or a composite thereof, although other materials such as plastic, wood and the like are contemplated.

Figure 3:
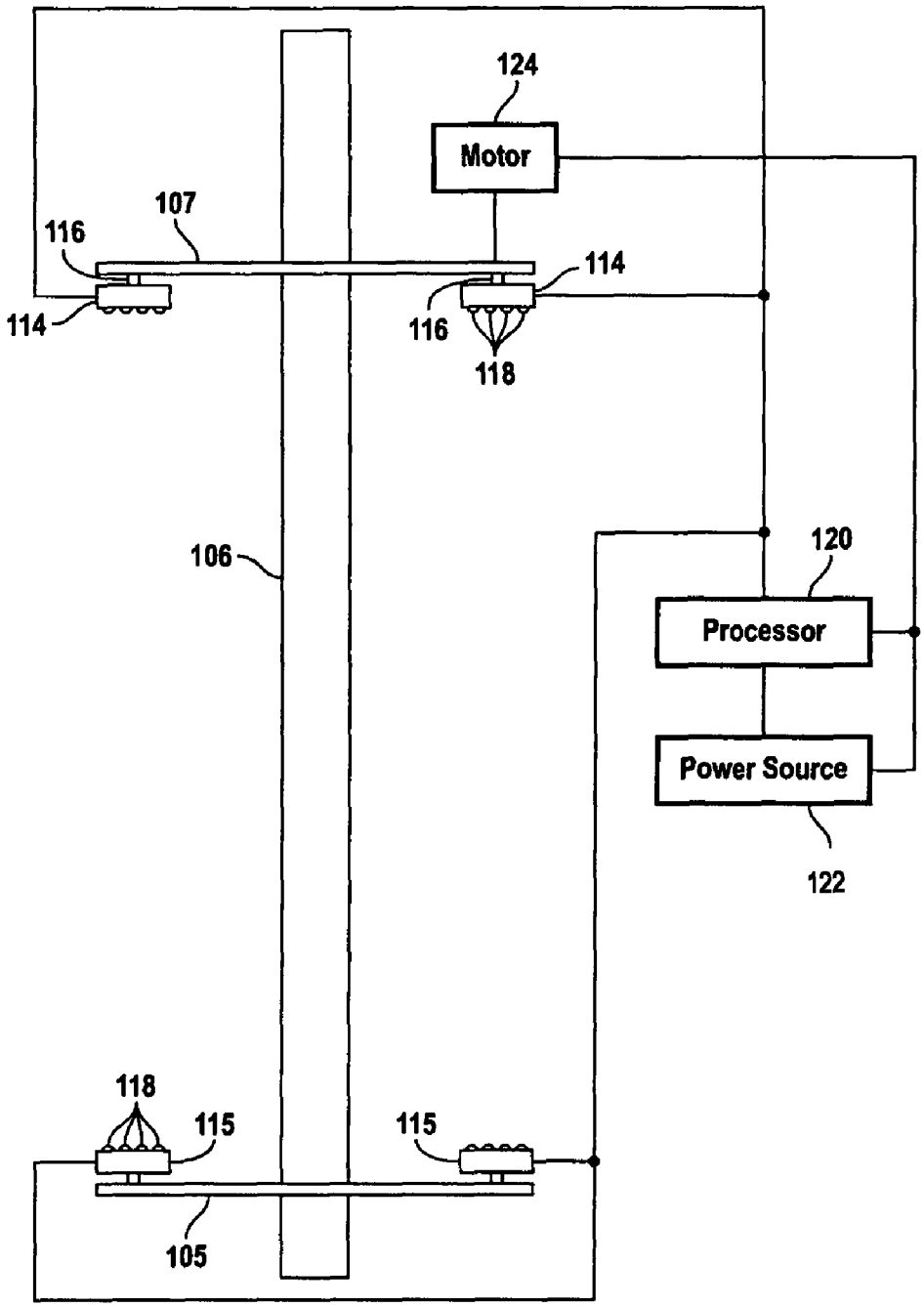
FIG. 3 illustrates a side view of the interior components of the tower in accordance with an embodiment.

FIG. 3 illustrates a side view of the support structure in accordance with an embodiment. As shown in FIG. 3, the support structure is shown to include the center shaft 106 along with the bottom and top circular supports 105, 107. As shown in FIG. 3, the support structure includes a plurality of lighting sources 118 in which the light sources 118 are configured in various light housings 114, 115. In FIG. 3, each light housing 114, 115 is shown to include four light sources 118, such as light emitting diodes (LEDs) or the like, although any other number of light sources 118 are contemplated. As shown in FIG. 3, the tower 100 is shown to include a pair of light housings 114 coupled to the upper support 107 such that the light sources 118 are oriented to face downward toward the ground surface. Additionally or alternatively, light sources 118 are configured on light housing 115 which are coupled to the lower support 105 and are oriented such that the light sources 118 face upward away from the ground surface. It should be noted that a greater or lesser number of light housings 114, 115 on one or more of the support rings 105, 107 may be utilized in the tower 100.

In addition, as shown in FIG. 3, the tower preferably includes a power source 122 coupled to the light source 118, and a processor 120 coupled to the light source 118 and the power source 122. The processor 120 preferably includes a memory which stores data. The power source 122 is preferably a rechargeable 12V battery.

It is preferred that the tower 100 includes one or motors 124 coupled to the light source 122 as well as the processor 120. In an embodiment, the motor 124 is coupled to the light housing 114, whereby the motor 124 causes the light housing 114 to rotate via the shaft 116. Although not show, the tower 100 may be configured to include a solar collector cell coupled to the power source 122 which recharges the power source 122. Although not shown in the Figures, it is contemplated that the solar collector cell may be additionally configured to drive one or more of the other electronic components of the tower 100.

It is preferred that the processor 120 is programmable to configure the motor 124 and/or light source 118 to produce light in a desired manner. In an embodiment, the processor 120 may be programmed to vary the current and/or voltage supplied to the light source 118 to vary the light output in a predetermined manner. For example, the processor 120 may gradually and continuously vary the current supplied to the light source 118 in a continuous manner such that the light from the light source 118 gradually brightens and then dims in a continuous manner. In another example, the processor 120 may be configured to cause the light source 118 to randomly vary the brightness of the light output. In an embodiment in which the light source 118 is capable of outputting more than one color, the processor 120 may cause two or more colors to be output simultaneously or in sequential order. It should be noted that the tower 100 may employ a combination of two or more of the above.

Figure 4:
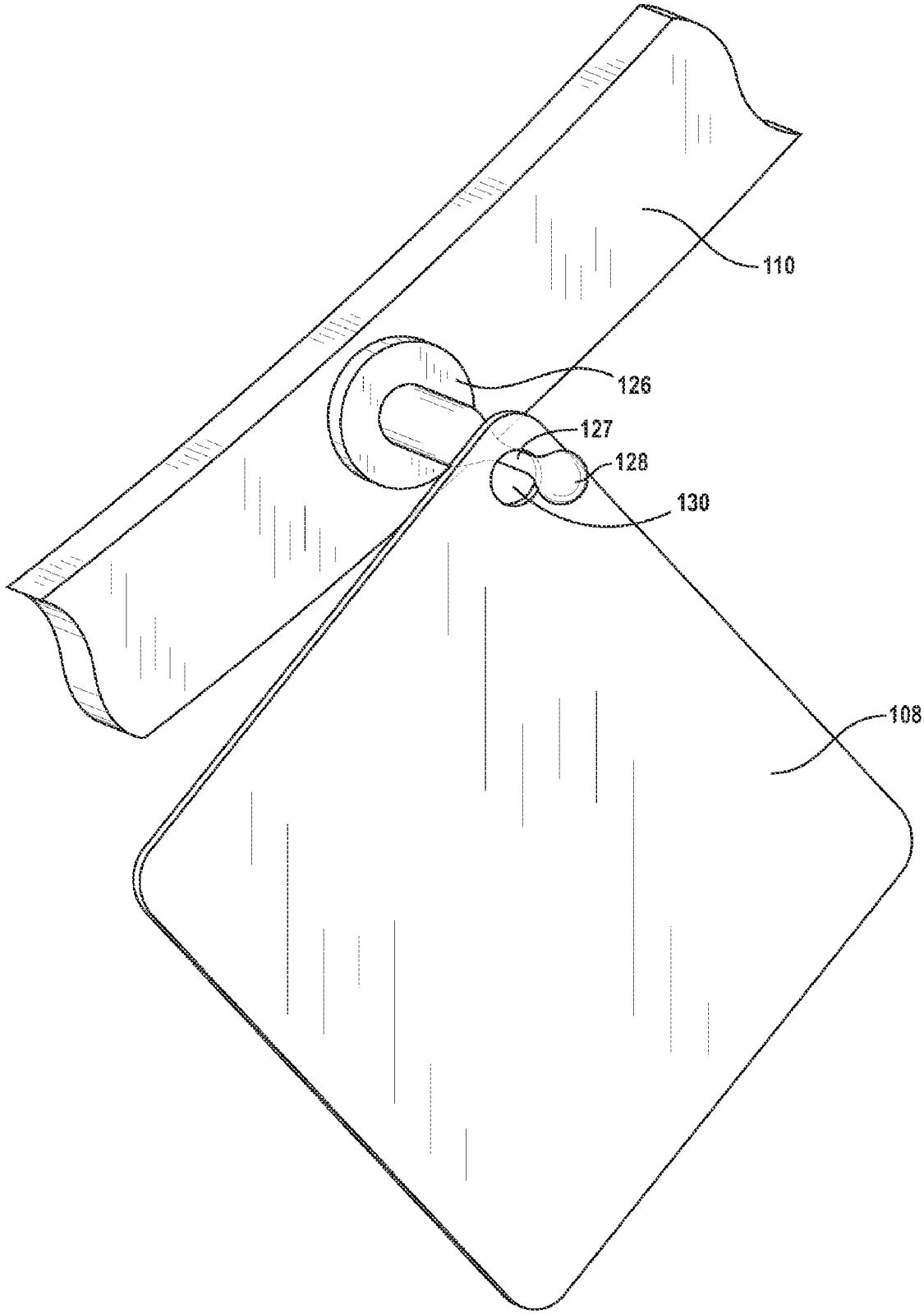
FIG. 4 illustrates a perspective view of the leaf and protrusion assembly in accordance with an embodiment.

FIG. 4 illustrates a perspective view of the leaf and leaf attachment assembly in accordance with an embodiment. FIG. 4 shows an outer surface of a portion of a rib, whereby a protrusion 126 is mounted to the outer surface of the rib 110. The protrusion 126 preferably extends from the outer surface of the rib 110 in a direction substantially perpendicular to the outer surface of the rib 110, as shown in FIG. 4.

The protrusion 126 preferably has a first cross sectional diameter proximal to the outer surface of the rib 110, whereby the protrusion 126 preferably decreases its cross sectional diameter 127 at a distance from rib 110 and then increases in cross sectional diameter 128 distally from the rib 110. The protrusion 126 allows a leaf 108 having an aperture 130 to be hung from the protrusion 126, whereby the aperture 130 has a diameter preferably substantially similar to the diameter of the distal portion 128 of the protrusion 126. Thus, the leaf 108 is able to be hung from the protrusion 126 whereby the leaf 108 is not easily removable from the protrusion 126. However, it is preferred that the leaf 108 hangs from the protrusion 126 around the area 127 such that the difference between the diameter of the protrusion at area 127 and the diameter of the aperture 130 is large enough that the leaf 108 is able to freely move in any direction about the protrusion 126. Considering that light emitted from the light source 118 within the interior of the outer body 102 is able to pass around the leaf 108 when the leaf 108 is moving in response to any external forces, such as wind, will thereby cause the leaf 108 to move in response to the forces. As discussed above, it is preferred that the tower 100 include a plurality of leaves 108 which are hung from corresponding protrusions 126. Thus, wind blowing past the tower 100 will cause some or all of the leaves 108 to move in response to the wind, thereby allowing light emitted from within the outer body 102 to pass through gaps between leaves 108 which are formed by the movement of the leaves 108.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. A tower comprising:

a base configured to sit upon a surface;

a light source coupled to the base and positioned a first horizontal distance from a center of the base, the light source configured to produce light therefrom when energized;

a cylindrical outer body coupled to and positioned a second distance from the center of the base, wherein the second distance is greater than the first distance, the outer body oriented to extend vertically from the surface and configured to allow light from the light source to pass therethrough;

a plurality of leaves coupled to an outer surface of the outer body and configured to hang therefrom, the leaves configured to freely move with respect to the outer body when air flow is applied thereto, wherein light from the light source is viewable through the outer body when the leaves move.

2. The tower of claim 1, wherein one or more leaves are spaced apart to allow light from the light source to pass therebetween.

3. The tower of claim 1, further comprising a shaft coupled to the base and oriented to extend vertically with respect to the surface.

4. The tower of claim 1, wherein the outer body further comprises a plurality of individually spaced ribs, wherein each rib is configured to extend upward in a helical configuration with respect to a center.

5. The tower of claim 1, wherein the light source further comprises a light emitting diode (LED).

6. The tower of claim 1, wherein the light source is configured to be selectively moveable via a motor.

7. The tower of claim 1, wherein the leaves are made of at least partially transparent material.

8. The tower of claim 1, wherein each leaf includes an aperture therethrough to couple each leaf, wherein each leaf is coupled to the outer body via the aperture.

9. The tower of claim 8, further comprising a plurality of protrusions extending from the outer surface of the ribs, wherein the protrusions pass through corresponding apertures in the leaves to hang the leaves from the protrusions.

10. The tower of claim 1, wherein the outer body has a top and a bottom, the top having a first diameter and the bottom having a second diameter, wherein the outer body has a middle portion between the top and the bottom wherein the middle portion has a diameter smaller than the first and second diameters.

11. A tower comprising:

a base configured to sit upon a surface;

a center shaft coupled to the base and oriented to extend vertically with respect to the surface;

a plurality of individually spaced ribs coupled to the base, each rib having an interior surface and an outer surface, wherein each rib is configured to extend upward in a helical configuration with respect to the center shaft to form an outer surface of the tower;

a plurality of leaves coupled to the outer surface of one or more of the plurality of ribs;

a light source coupled to the base and located proximal to the interior surface of the ribs, wherein light produced by the light source passes at least through one spaced gap between adjacent ribs.

12. The tower of claim 11, wherein one or more leaves are spaced apart to allow light from the light source to pass therebetween.

13. The tower of claim 11, wherein the light source further comprises a light emitting diode (LED).

14. The tower of claim 11, wherein the light source is configured to be selectively moveable via a motor.

15. The tower of claim 11, wherein the leaves are made of at least partially transparent material.

16. The tower of claim 11, wherein each leaf includes an aperture therethrough to couple each leaf, wherein each leaf is coupled to the outer body via the aperture.

17. The tower of claim 16, further comprising a plurality of protrusions extending from the outer surface of the ribs, wherein the protrusions pass through corresponding apertures in the leaves to hang the leaves from the protrusions.

18. The tower of claim 11, wherein the outer body has a top and a bottom, the top having a first diameter and the bottom having a second diameter, wherein the outer body has a middle portion between the top and the bottom wherein the middle portion has a diameter smaller than the first and second diameters.

* * * * *